US008830258B2

(12) United States Patent
Rhodes et al.

(10) Patent No.: US 8,830,258 B2
(45) Date of Patent: Sep. 9, 2014

(54) GENERATING STROKES IN REAL-TIME ON AN ELECTRONIC PAPER DISPLAY

(75) Inventors: Bradley J. Rhodes, Alameda, CA (US); Kurt W. Piersol, Campbell, CA (US)

(73) Assignee: Ricoh Co., Ltd, Tokyo (JP)

( * ) Notice: Subject to any disclaimer, the term of this patent is extended or adjusted under 35 U.S.C. 154(b) by 519 days.

(21) Appl. No.: 13/042,445

(22) Filed: Mar. 7, 2011

(65) Prior Publication Data

US 2012/0229485 A1 Sep. 13, 2012

(51) Int. Cl.
*G09G 5/00* (2006.01)
*G09G 5/24* (2006.01)

(52) U.S. Cl.
CPC ..... *G09G 5/246* (2013.01)
USPC ..... 345/613; 345/441; 345/467; 345/551; 345/611; 382/258; 382/259; 382/269

(58) Field of Classification Search
USPC ..... 345/605, 611, 612, 613
See application file for complete search history.

(56) References Cited

U.S. PATENT DOCUMENTS

| | | | | |
|---|---|---|---|---|
| 5,613,019 | A * | 3/1997 | Altman et al. | 382/311 |
| 6,201,528 | B1 | 3/2001 | Lucas et al. | |
| 6,445,489 | B1 * | 9/2002 | Jacobson et al. | 359/296 |
| 6,559,858 | B1 * | 5/2003 | Schneider et al. | 345/611 |
| 7,646,387 | B2 * | 1/2010 | Dowling et al. | 345/469 |
| 2007/0076968 | A1 * | 4/2007 | Yang et al. | 382/240 |

FOREIGN PATENT DOCUMENTS

| | | |
|---|---|---|
| JP | 2-188818 | 7/1990 |
| JP | 2008-519318 | 6/2008 |
| JP | 2010-55374 | 3/2010 |

OTHER PUBLICATIONS

International Search Report for PCT/JP2012/055488, dated Apr. 10, 2012, 4 pages.

Written Opinion for PCT/JP2012/055488, dated Apr. 10, 2012, 3 pages.

* cited by examiner

*Primary Examiner* — Antonio A Caschera

(74) *Attorney, Agent, or Firm* — Patent Law Works

(57) ABSTRACT

A method and system for generating strokes in real-time on an electronic paper display. A display device receives the stroke input, which is converted to binary code by a digitizer. A rendering engine renders the high-resolution stroke data in non-antialiased form to an ink buffer. The rendering engine then updates pixels based on the color or gray level of the background (unlinked) pixel and the amount of ink covering the pixel.

20 Claims, 10 Drawing Sheets

425 425

| | | | | | | | |
|---|---|---|---|---|---|---|---|
| 1 | 1 | 1 | 0 | 0 | 0 | 0 | 0 |
| 0 | 1 | 1 | 1 | 0 | 0 | 0 | 0 |
| 0 | 1 | 1 | 1 | 0 | 0 | 0 | 0 |
| 0 | 0 | 1 | 1 | 1 | 0 | 0 | 0 |
| 0 | 0 | 1 | 1 | 1 | 0 | 0 | 0 |
| 0 | 0 | 0 | 1 | 1 | 1 | 0 | 0 |
| 0 | 0 | 0 | 1 | 1 | 1 | 0 | 0 |
| 0 | 0 | 0 | 0 | 1 | 1 | 1 | 0 |

425 425

Figure 4B

GENERATING STROKES IN REAL-TIME ON AN ELECTRONIC PAPER DISPLAY

BACKGROUND OF THE INVENTION

1. Field of the Invention

The present embodiment of invention relates to generating strokes in real-time on an electronic paper display. In particular the present invention relates to generating strokes on an electronic paper display by converting stroke input to binary code and filling in pixels using a grayscale.

2. Description of the Background Art

The use of electronic paper display devices has become commonplace for many users. Examples of present-day electronic paper display devices include electronic devices for reading such as the Reader™ from Sony Corp., the Kindle™ from Amazon and the Nook™ from Barnes & Noble. There have also been increased sales of tablet computers offering different levels of processing capability and size.

The screens on the electronic paper displays are composed of pixels. When an image is converted from vector data into pixel data, i.e. rasterized, the image is broken down and displayed in the pixels. FIG. 1A is a prior art example of a rasterized image. Lines drawn on a display, for example lines tracing the path of a stylus used to generate electronic "ink" on the display, can be rendered with minimal computation using a number of algorithms, the most well known being Bresenham's Line Algorithm. Similar algorithms are well known for rendering curved lines that have been interpolated from a set of sample locations generated by a stylus or other stroke capture device. One well-known problem with such rasterization algorithms are the appearance of "jaggies": stair-like visual artifacts that appear where there should be smooth straight lines or curves. Jaggies are a natural result of rendering non-vertical or horizontal lines using a regular grid of pixels, and they can be quite noticeable even on moderate resolution displays.

One prior art attempt to fix the jaggies problem is called anti-aliasing and refers to a process of using intermediate levels of gray around the edges of the line to blend the pixels together. Anti-aliasing smoothes out jagged lines by surrounding them with semi-transparent pixels to simulate the appearance of fractionally-filled pixels. The result is what appears to be smoother lines than would be possible given the display's spatial resolution, albeit at a cost of lowering spatial contrast. FIG. 1B is a prior art example of the result of applying anti-aliasing to the @ symbol.

One anti-aliasing technique for rendering images is called supersampling because each unit of the image that is rasterized for a pixel is sampled multiple times in different parts of the unit and the sampled colors are averaged. In order to properly sample the image, the image is rendered at a high resolution and then downsampled for display. The amount of buffer required for supersampling is larger than other rasterizing techniques. As a result, supersampling is computationally expensive.

In the sub-domain of line drawing, several algorithms attempt to avoid the computational overhead of supersampling by computing the transparency of pixels along the edges of a rasterized line as a function of the distance of the pixel from the center of the ideal line. When drawing simple lines and curves these methods produce a reasonable approximation to what would be obtained using supersampling, and are much more efficient Inking, that is rendering the path of a stylus or similar stroke capture device in near real-time to a display, presents challenges that are not properly handled by the above-described algorithms. In particular, inking involves rendering a foreground image (the ink) against a background image (the document or graphics upon which the ink is being "written"). As the tablet generates samples, ink is rendered to the display as narrow bands overlayed on top of the background. When anti-aliasing is performed correctly, the color of a pixel that would only be partially covered by the ideal path of a pen stroke should be a combination of the ink color and the background color, the combination determined by the amount of ink covering the pixel.

For example, if black ink were to cover 50% of a white pixel the resulting color might be mid-gray. Typically the above-described algorithms would perform such blending and then write the resulting color to the frame buffer as the new pixel color. This presents a problem when ink overlaps with ink that has previously been rendered, as it would when drawing an "X" or "K." In such a case, the amount of additional coverage of the pixel depends on where on the pixel the previous ink covered, and may result in anywhere from no change to the pixel color (if the new ink only affected pixel regions already inked) to a completely additive effect if the new and old ink cover entirely different regions of the pixel. Some prior art attempts to address this problem propose identifying whether a rendered pixel has previously been inked by reserving a set of entries in the color table solely for ink and then only applying new ink if it would result in a darker color than currently rendered. This heuristic avoids unsightly dark spots where ink crosses other ink, but in many cases it leaves the pixels of intersection lighter than proper anti-aliasing would produce.

SUMMARY OF THE INVENTION

The present embodiment of invention overcomes the deficiencies and limitations of the prior art by providing a method and system for generating strokes on an electronic paper display. In contrast to existing prior art, the present embodiment of the invention does not attempt to replace supersampling with a more efficient heuristic that approximates its accuracy, but instead applies supersampling to the domain of real-time inking in an efficient manner. In particular, the present embodiment of the invention provides an electronic paper display with a display device, such as a tablet that receives input and transmits the input to a stroke capture module that generates stroke data for display in real time. In one embodiment the stroke capture module includes an input/output module for receiving stroke data and transmitting the stroke data to a rendering engine and communicating with an ink buffer, a rendering engine for converting the stroke data into a format for saving in the ink buffer and determining a shade of grey to display for each pixel.

In one embodiment, the display device receives stroke data at a higher resolution than that of the display. A rendering engine renders the high-resolution stroke data in non-anti-aliased form to an ink buffer. The rendering engine then updates pixels based on the color or gray level of the background (unlinked) pixel and the amount of ink covering the pixel. The ink buffer is implemented in such a way that determining the amount of ink covering a pixel is fast and efficient.

The stroke capture module also includes a handwriting recognition module for identifying the character intended by the user. Once the characters are determined, the character data is transmitted by the input/output module to a presentation module that prepares the character data for display using the display device.

The present embodiment of the invention also includes a novel method for rendering stroke data, converting high resolution stroke data into pixel data and implementing updates.

The features and advantages described herein are not all-inclusive and many additional features and advantages will be apparent to one of ordinary skill in the art in view of the figures and description. Moreover, it should be noted that the language used in the specification has been principally selected for readability and instructional purposes, and not to limit the scope of the inventive subject matter.

BRIEF DESCRIPTION OF THE DRAWINGS

The invention is illustrated by way of example, and not by way of limitation in the figures of the accompanying drawings in which like reference numerals are used to refer to similar elements.

FIG. 4B is a graphical representation of received stroke data in accordance with the present embodiment of invention.

DETAILED DESCRIPTION OF THE PREFERRED EMBODIMENTS

Figure 1A:
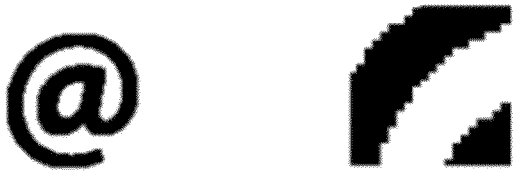
Figure 1a (Prior Art)
FIGS. 1A and 1B are prior art representations of rasterized images.
Figure 1B:
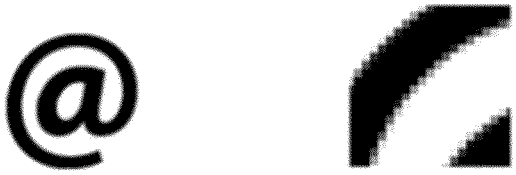
Figure 1b (Prior Art)

A system for generating strokes on an electronic paper display is described. In the following description, for purposes of explanation, numerous specific details are set forth in order to provide a thorough understanding of the invention. It will be apparent, however, to one skilled in the art that the invention can be practiced without these specific details. In other instances, structures and devices are shown in block diagram document in order to avoid obscuring the invention. For example, the present embodiment of invention is described in one embodiment below with reference to electronic paper displays that are exemplified in a hardware and software platform like the Amazon Kindle that utilize electronic paper, e-paper or electronic ink display. However, the present embodiment of invention applies to any type of portable computing device that can capture ink, data and commands, and send documents electronically.

Reference in the specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment. In particular the present embodiment of invention is described below in the content of two distinct architectures and some of the components are operable in both architectures while others are not.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self consistent sequence of steps leading to a desired result. The steps are those requiring physical manipulations of physical quantities. Usually, though not necessarily, these quantities take the document of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present embodiment of invention also relates to an apparatus for performing the operations herein. This apparatus may be specially constructed for the required purposes, or it may comprise a general-purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, each coupled to a computer system bus.

The invention can take the document of an entirely hardware embodiment, an entirely software embodiment or an embodiment containing both hardware and software elements. In a preferred embodiment, the invention is implemented in software, which includes but is not limited to firmware, resident software, microcode, etc.

Furthermore, the invention can take the document of a computer program product accessible from a computer-usable or computer-readable medium providing program code for use by or in connection with a computer or any instruction execution system. For the purposes of this description, a computer-usable or computer readable medium can be any apparatus that can contain, store, communicate, propagate, or transport the program for use by or in connection with the instruction execution system, apparatus, or device.

The medium can be an electronic, magnetic, optical, electromagnetic, infrared, or semiconductor system (or apparatus or device) or a propagation medium. Examples of a computer-readable medium include a semiconductor or solid state memory, magnetic tape, a removable computer diskette, a random access memory (RAM), a read-only memory (ROM), a rigid magnetic disk and an optical disk. Current examples of optical disks include compact disk-read only memory (CD-ROM), compact disk-read/write (CD-R/W) and DVD.

A data processing system suitable for storing and/or executing program code will include at least one processor coupled directly or indirectly to memory elements through a system bus. The memory elements can include local memory employed during actual execution of the program code, bulk storage, and cache memories which provide temporary storage of at least some program code in order to reduce the number of times code must be retrieved from bulk storage during execution.

Input/output (I/O) devices (including but not limited to keyboards, displays, pointing devices, etc.) can be coupled to the system either directly or through intervening I/O controllers.

Network adapters may also be coupled to the system to enable the data processing system to become coupled to other data processing systems or remote printers or storage devices through intervening private or public networks. Modems, cable modem and Ethernet cards are just a few of the currently available types of network adapters.

Finally, the algorithms and displays presented herein are not inherently related to any particular computer or other apparatus. Various general-purpose systems may be used with programs in accordance with the teachings herein, or it may prove convenient to construct more specialized apparatus to perform the required method steps. The required structure for a variety of these systems will appear from the description below. In addition, the present embodiment of invention is described with reference to a particular programming language. It will be appreciated that a variety of programming languages may be used to implement the teachings of the invention as described herein.

System Overview

Figure 2:
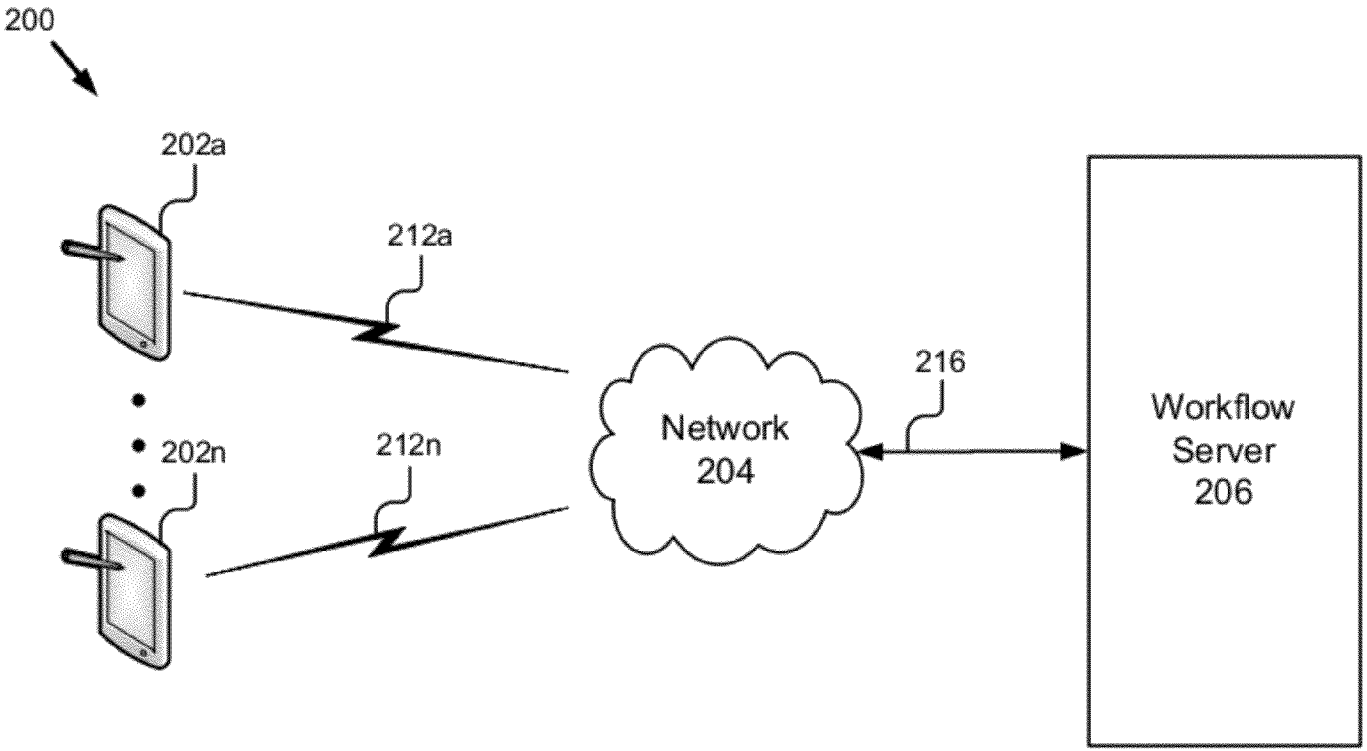
FIG. 2 is a block diagram of an embodiment of a system for routing documents in accordance with the present embodiment of invention.

FIG. 2 shows an embodiment of a system 200 for transmitting documents between electronic paper displays and a server. Referring now to FIG. 2, this embodiment of system 200 comprises: a plurality of electronic paper displays 202*a*-202*n*, a network 204, and a workflow server 206.

The plurality of electronic paper displays 202*a*-202*n* is wirelessly coupled to the network 204 via respective couplings 212*a*-212*n*. The electronic paper display 202 is coupled to the workflow server 206 via the network 204. The electronic paper displays 202*a*-202*n* include a display, stroke capture capability, handwriting recognition capability and a wireless communication capability. The electronic paper displays 202*a*-202*n* are adapted to receive images (e.g., documents or forms), add stroke annotations to the received images, and send the annotated received images. Embodiments of the electronic paper display 202*a*-202*n* will be described in more detail below with reference to FIG. 3A.

The network 204 is a conventional type, wired or wireless, and may have any number of configurations such as a star configuration, token ring configuration or other configurations known to those skilled in the art. Furthermore, the network 204 may comprise a local area network (LAN), a wide area network (WAN) (e.g., the Internet), and/or any other interconnected data path across which multiple devices may communicate. In yet another embodiment, the network 204 may be a peer-to-peer network. The network 204 may also be coupled to or includes portions of a telecommunications network for sending data in a variety of different communication protocols. In yet another embodiment, the network 104 includes Bluetooth communication networks or a cellular communications network for sending and receiving data such as via short messaging service (SMS), multimedia messaging service (MMS), hypertext transfer protocol (HTTP), direct data connection, WAP, email, etc.

The workflow server 206 is coupled to the network 204 via signal line 216 for communication with the electronic paper displays 102*a*-102*n*. The workflow server 206 includes modules for receiving data, logging changes in documents, selling applications and documents, registering devices, applications and forms, etc. The modules are described in greater detail in FIG. 3B. In one embodiment, the electronic paper display 202 transmits the captured stroke data and transmits it to the workflow server 206 for processing.

Although the system of FIG. 2 shows only one workflow server 206, it should be understood that there could be any number of additional workflow servers, for example dedicated to other functions, companies, institutions, organizational structures. An electronic paper display 202 may communicate with more than one workflow server 206. Particular pages or sections of a document could be associated with different workflow servers. Also, portions of a compound document can be forwarded rather than sending the entire compound document.

Electronic Paper Display 202

Figure 3A:
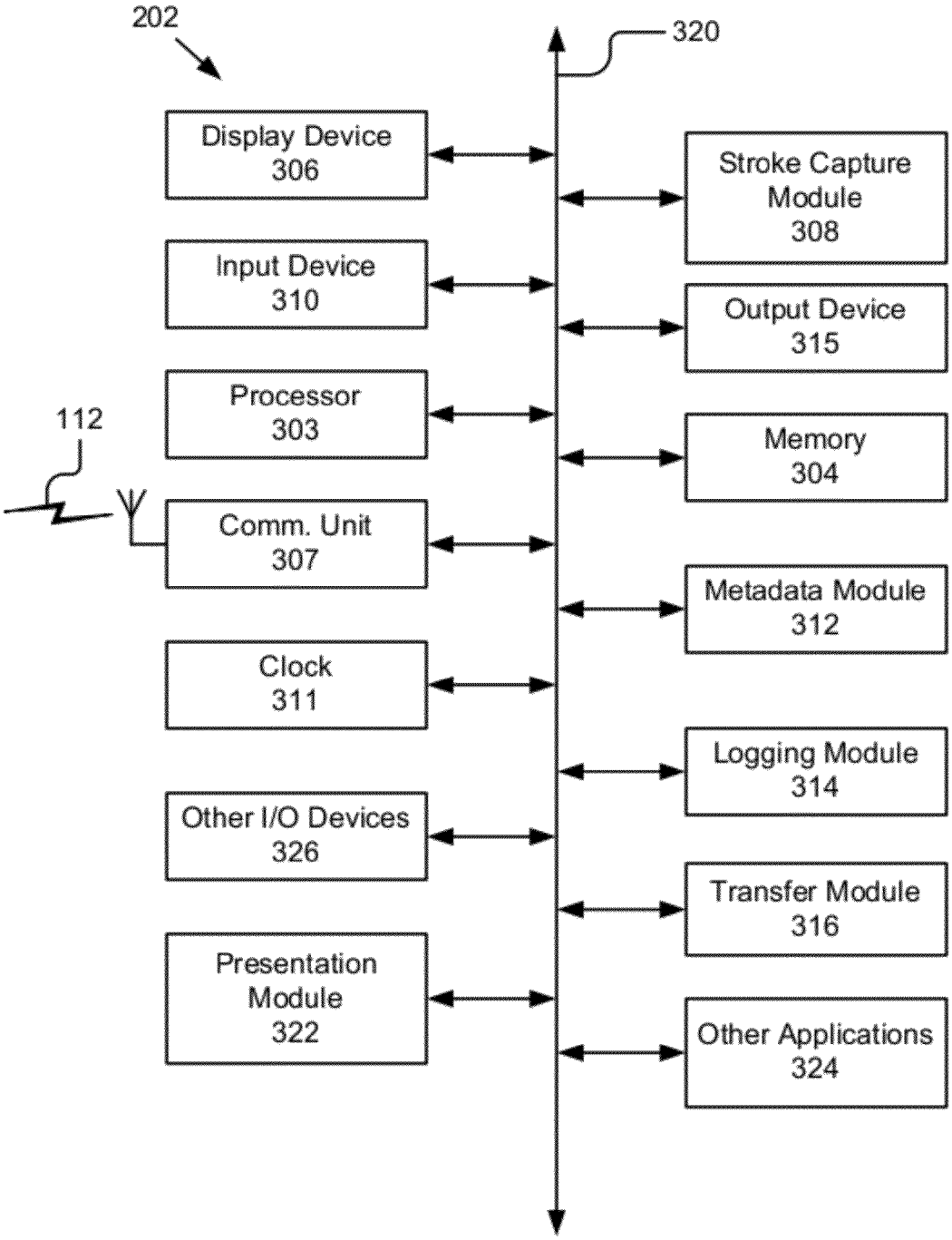
FIG. 3A is a block diagram of an embodiment of an electronic paper display in accordance with the present embodiment of invention.

Referring now to FIG. 3A, the components of an electronic paper display 202 are described. The electronic paper display 202 comprises a display device 306, a stroke capture module 308, an input device 310, an output device 315, a processor 303, a memory 304, a communication unit 307, a clock 311, a metadata module 312, other input/output (I/O) devices 326, a logging module 314, a transfer module 316, a presentation module 322 and other applications 324.

The processor 303 comprises an arithmetic logic unit, a microprocessor, a general purpose controller or some other processor array to perform computations, provide electronic display signals to display device 306, and detect and process stroke inputs. The processor 303 is coupled to the bus 320 for communication with the other components of the electronic paper display 202. Processor 303 processes data signals and may comprise various computing architectures including a complex instruction set computer (CISC) architecture, a reduced instruction set computer (RISC) architecture, or an architecture implementing a combination of instruction sets. Although only a single processor is shown in FIG. 3A, multiple processors may be included. The processing capability of the electronic paper display 202 may be limited to supporting the display of images and the recording strokes and the transmission of strokes. The processing capability might be enough to perform more complex tasks, including various types of image processing, stroke processing, or recognition tasks. It will be obvious to one skilled in the art that other processors, operating systems, sensors, displays and physical configurations are possible. The electronic paper display 202 also includes an operating system executable by the processor such as but not limited to WINDOWS®, MacOS X®, Android®, or UNIX®, based operating systems.

The memory 304 stores instructions and/or data that may be executed by processor 303. The instructions and/or data may comprise code for performing any and/or all of the techniques described herein. The memory 304 may be a dynamic random access memory (DRAM) device, a static random access memory (SRAM) device, flash memory or some other memory device known in the art. In one embodiment, the memory 304 also includes a non-volatile memory such as a hard disk drive or flash drive for storing log information on a more permanent basis. The memory 304 is coupled by the bus 320 for communication with the other components of the electronic paper display 202.

The communication unit 307 is coupled to an antenna 112 and the bus 320. An alternate embodiment, the communication unit 307 may provide a port for direct physical connection to the network 204. The communication unit 307 includes a transceiver for sending and receiving compound documents. In one embodiment, the communication unit 307 includes a Wi-Fi transceiver for wireless communication with an access point. In another embodiment, the communication unit 307 includes a Bluetooth® transceiver for wireless communication with other devices. In yet another embodiment, the communication unit 307 includes a cellular communications transceiver for sending and receiving data over a cellular communications network such as via short messaging service (SMS), multimedia messaging service (MMS), hypertext transfer protocol (HTTP), direct data connection, WAP, email, etc. In still another embodiment, the communication unit 307 includes ports for wired connectivity such as but not limited to USB, SD, or CAT-5, etc. The communication unit 307 links the processor 303 to the network 204 that may include multiple processing systems. The network of processing systems may comprise a local area network (LAN), a wide area network (WAN) (e.g., the Internet), and/or any other interconnected data path across which multiple devices may communicate. The communication unit 307 also provides other conventional connections to the network 204 for distribution of files (media objects) using standard network protocols such as TCP/IP, HTTP, SSH, git HTTPS and SMTP as will be understood to those skilled in the art.

The clock 311 is a conventional type and provides an indication of local time for the electronic paper display 202. In particular, the clock 311 is used to provide a local time at which stroke data files are processed. This time value is also stored with data in the local log files using the logging module 314. The clock 311 is adapted to communicate this information to the processor 203 and the logging module 314 using the system bus 320.

The metadata module 312 is software including routines for extracting metadata from a document or image and storing metadata as part of a document. In one embodiment, the metadata module 312 is instructions executable by the processor 303 to generate and extract metadata regarding the stroke data. In one embodiment, the metadata module 312 is stored in the memory 304 and is accessible and executable by the processor 303. In any event, the metadata module 312 is adapted for cooperation and communication with the processor 303, the image capture module 328, the logging module 314 and other components of the electronic paper display 202.

The logging module 314 is software including routines for creating and storing local logs in the memory 304, and more particularly, in a nonvolatile storage portion of the memory 304. In one embodiment, the logging module 314 is a set of routines executable by the processor 303 to store metadata in an entangled log at the electronic paper display 202. In one embodiment, the logging module 314 also includes routines for publishing or storing in a publicly available location on the network the logs of its particular electronic paper display 202. The logging module 314 is coupled by the bus 320 to the processor 303, the memory 304, the image capture module 328 and the communication unit 307.

The transfer module 316 is software and routines for transmitting and receiving data to and from the workflow server 106. In one embodiment, the transfer module 316 transmits stroke data to the workflow server 106 for processing. In other embodiments, the transfer module 316 sends and receives documents as formatted messages from any other electronic paper display such as the workflow server 206. The transfer module 316 is coupled by the bus 320 for communication with the processor 303 and the communication unit 307. The transfer module 316 is responsible for transmitting and receiving the stroke data from the electronic paper display 202 such as by email, file transfer, XMPP or special purpose application.

Aligned with the stroke capture module 308, there is a display device 306 such as a tablet or graphics pad. The display device 306 is a contact sensing device or a sonic, electromagnetic or light sensing device with receivers. In one embodiment, the display device 306 is simple sensors that return horizontal and vertical position of a single point of contact. In yet another embodiment, the display device 306 is a plurality of more complex sensors that return an indication of pressure, location, time, and even a stylus ID number or type or indication if a button is pressed on a stylus or the stylus has been inverted, e.g. to erase. Some sensors might return multiple points of contact. Some sensors might be able to distinguish between stylus and finger based touch input.

The display device 306 is capable of accepting strokes from a stylus, a finger or another implement. The display device 306 is a sensor for the stylus and has resolution sufficient to capture recognizable handwriting and printing and other drawings. In one embodiment, display device 306 is equipped with a touch screen in which a touch sensitive, transparent panel covers the screen of display device 306. The display device 306 is coupled by the bus 320 to the memory 304, the processor 303, the stroke capture module 308, the presentation module 322 and the communication unit 307.

The display device 306 transmits the stroke data to the stroke capture module 308, which converts the analog signal to digital data, renders the stroke data and performs handwriting recognition. In one embodiment, the stroke capture module 308 includes a digitizer manufactured and sold by Wacom Co., Ltd. The digitizer converts the analog signal into binary code for the x and y coordinates of the stroke data.

The bus 320 represents a shared bus for communicating information and data throughout the electronic paper display 202. The bus 320 may represent one or more buses including an industry standard architecture (ISA) bus, a peripheral component interconnect (PCI) bus, a universal serial bus (USB), or some other bus known in the art to provide similar functionality. Additional components coupled to processor 303 through system bus 320 include the display device 306, the stroke capture module 308, the input device 310, the output device 315, the processor 303, the memory 304, the communication unit 307, the clock 311, the metadata module 312, the logging module 314, the transfer module 316, the presentation module 322 and the other applications 324. There may also be a plurality of busses in computing system 202, designed to provide the most efficient communications between functional elements.

The presentation module 322 is software and routines for displaying documents on the display device 306, and adjusting the display of the image responsive to input from input device 310. The presentation module 322 performs routines that cause the dual mode user interface to be displayed. In one embodiment, the presentation module 322 is a thin client routine executable by the processor 303 to cause display of the image on the display device 306. The presentation module 322 is coupled by the bus 320 to the display device 306, the processor 303, and the memory 304.

The other applications 324 include other software and routines executable by the processor 303 for various other types of functionality. In one embodiment, one or more application programs are executed by the processor 303 including, without limitation, word processing applications, electronic mail applications, financial applications, and web browser applications.

Finally, the electronic paper display 202 may include one or more other I/O devices 326. For example, the other I/O devices 326 may include speakers to produce sound, microphones to record sound, a scanner or camera to record documents, images or video, and other sensors or feedback devices like accelerometers, pager motors, or haptic feedback. Optionally, the other I/O devices 326 may include one or more analog-to-digital or digital-to-analog converters, and/or one or more digital signal processors to facilitate audio processing. These other I/O devices 326 are coupled by bus 320 for communication with the processor 303 and the memory 304. Optionally, a microcontroller may be added as part of other I/O Devices 326 to facilitate power systems control, as well as off-load the main processor 303 from lower-speed lesser-important tasks.

Workflow Server 206

Figure 3B:
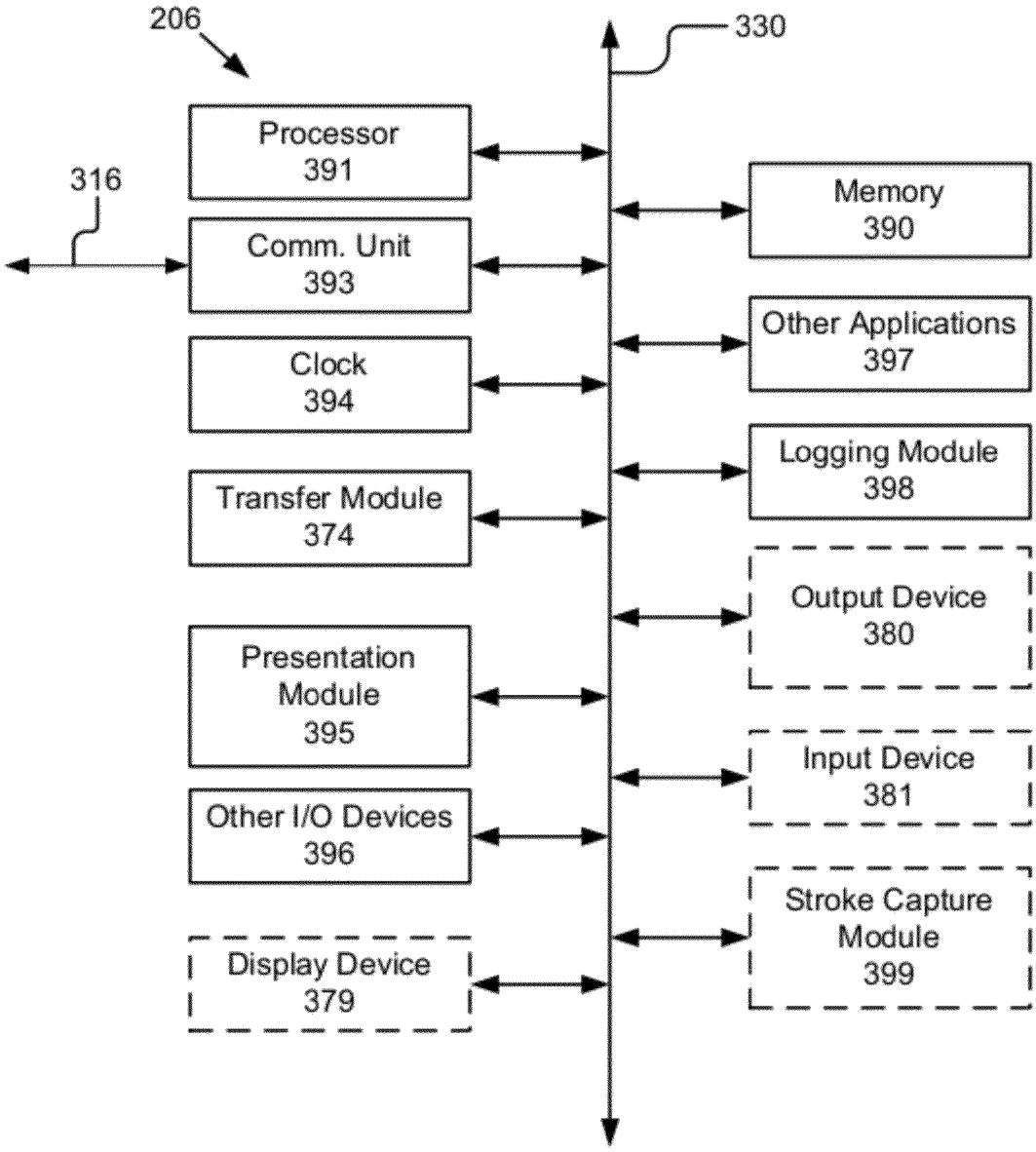
FIG. 3B is a block diagram of a workflow server in accordance with the present embodiment of invention.

Referring now to FIG. 3B, an embodiment of the workflow server 206 will be described in more detail. The workflow server 206 comprises a processor 391, a memory 390, a communication unit 393, a clock 394, a transfer module 374, a presentation module 395, a registration module 375, other input/output devices 396, other applications 397 and a logging module 398. In an alternate embodiment, the workflow server 206 further comprises a display device 379, an output device 380, an input device 381 and a stroke capture module 399 coupled to the bus 330.

Those skilled in the art will recognize that some of the components of the workflow server 206 have the same or similar functionality to the components of the electronic paper display 202 so descriptions of these components will not be repeated here. For example, the processor 391, the memory 390, the communication unit 393, the logging module 398, the clock 394, the transfer module 374, the presentation module 395, the other input/output devices 396, the other applications 397, the display device 379, the output device 380 and the input device 381 have a similar functionality to the processor 303, the memory 304, the communication unit 307, the logging module 314, the clock 311, the transfer module 316, the presentation module 322, the other input/output devices 326, the other applications 324, the display device 306, the output device 315, and the input device 310 of FIG. 3A, respectively.

Some differences between the components of the workflow server 206 and the electronic paper display 202 are noted below. For example, the communication unit 393 may couple the workflow server 206 to the network 204 in a wired manner instead of wirelessly. The processor 391 is more computationally powerful than the processor 303 as the workflow server 206 likely services numerous portable computing devices 202. The transfer module 374 is an e-mail server as opposed to an e-mail client. The display device 379 may be a cathode-ray tube, and the output device 380 is a set of speakers. The input device 381 includes a keyboard and mouse type controller. Those skilled in the art will recognize that there may be a variety of other differences as the components of the workflow server 106 acts as a hardware server as opposed to a remote client.

The logging module 398 generates a document log from the logs that are transmitted from the different electronic paper displays 202. The document log is a central log of all activities that occurred with the document at the different electronic paper displays 202. The document log includes the hashes from the page logs but not the details regarding what specifically occurred during each transaction. The specific actions can be recreated by retrieving the metadata associated with the document.

In one embodiment, the memory 390 stores all workflow server 206 data. In an alternate embodiment, data storage is coupled to the workflow server 106. For example, in such an alternate embodiment, the data storage is an online storage service such as Amazon S3. The data storage is a non-volatile memory device or similar permanent storage device and media. Data storage device stores data and instructions for processor 391 and comprises one or more devices including a hard disk drive, a floppy disk drive, a CD-ROM device, a DVD-ROM device, a DVD-RAM device, a DVD-RW device, a flash memory device, or some other mass storage device known in the art. The data storage is used to store the applications and associated metadata including stroke data, hashes, identifiers, secret keys, signatures, etc.

Stroke Capture Module 308

Figure 4A:
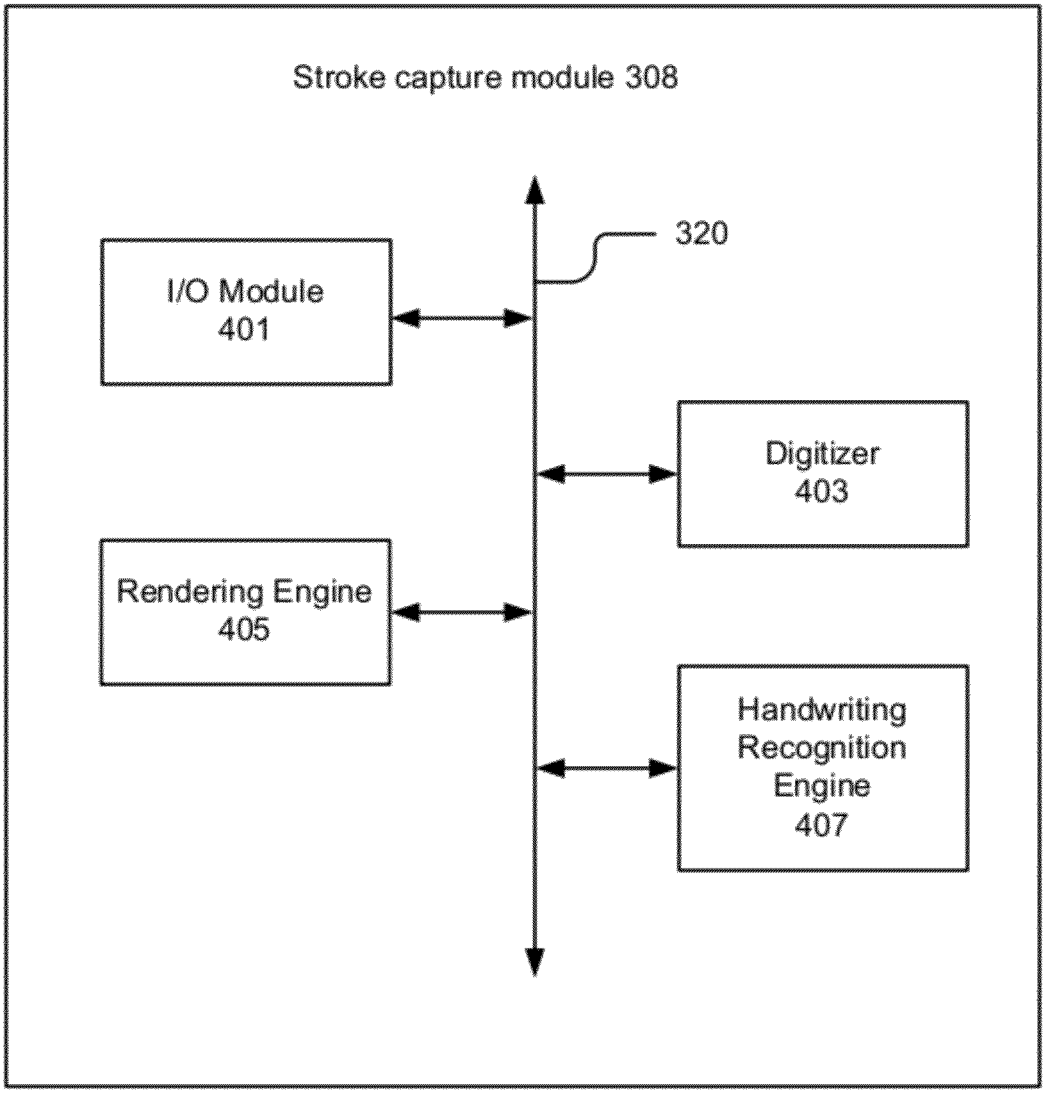
FIG. 4A is a block diagram of a stroke capture module in accordance with the present embodiment of invention.

FIG. 4A is one embodiment of a stroke capture module 308 that comprises an input/output module 401, a digitizer 403, a rendering engine 405 and a handwriting recognition engine 407 that are coupled to the bus 320.

The I/O module 401 receives data and transmits the data to the digitizer 403, the rendering engine 405 and the handwriting recognition engine 407.

In one embodiment, the digitizer 403 receives the stroke data from the I/O module 401 as an analog signal. The digitizer 403 converts the analog signal into binary code for the x and y coordinates. The digital version of the stroke data is transmitted to the rendering engine 405.

The rendering engine 405 converts the binary code into line data, fills in pixels and instructs the presentation module 322 to display the rasterized data. The I/O module 401 transmits the rasterized data to the presentation module 322 for display on the display device 306.

The handwriting recognition engine 407 receives the rasterized data and performs a handwriting recognition analysis to identify characters within the handwriting. In one embodiment, the handwriting recognition engine 407 makes predictions about the characters intended by the user and transmits the prediction for each character to the presentation module 322 for display. In another embodiment, the handwriting recognition engine 407 transmits a list of predictions to the presentation module 322 for display. The predictions are based off of factors such as common usage, user history and context.

Rendering Engine 405

The binary code is transmitted from the digitizer 403 to the rendering engine 405, which stores the binary code in an ink buffer that is part of the memory 304. In the simplest form, a stroke is just a list of x-y locations where the stylus, pen or other pointing device, like a finger, was sensed and the time of contact. This information is associated with the background image that was showing when the strokes were written and it should be possible to scale and orient the strokes so that it is later possible to match what the user saw. In addition to the x-y locations, the stroke segment device 208 captures the time of each stroke or each point, the pressure of the stylus, which stylus was used or which end of a stylus was used (if the hardware supports this). It may even be useful to store information about the algorithm being used on the pen to convert pen strokes into pixels e.g. what width and color pen are lines being drawn in, and how are points selected between sensed points.

The rendering engine 405 classifies segments in a variety of ways. In a first embodiment, the rendering engine 405 stores stroke data using a binary storage technique allocating the appropriate number of bits or bytes to each point, e.g. 2 bytes per x coordinate and 2 bytes per y coordinate, this is more memory efficient.

In a second embodiment, the stroke data is stored as InkML. InkML is an XML format that allows storage of strokes and a variety of additional data, specified by the W3C and is described in the technical report, Ink Markup Language (InkML), W3C Working Draft 23 Oct. 2006 InkML allows some memory efficiency as well, and if necessary the data can be compressed by a text compressor.

In a third embodiment, the stroke data is stored as simple text based lists comprising an x-value, a space, a y-value, and a line feed, with the end of a stroke indicated by a point outside the drawable space. For example, the electronic paper display 202 might allow x coordinates between 0 and 1200 and y coordinates between 0 and 1600, a point recorded as "−1, −1" is not in the drawable space and can be used to terminate the stroke.

In one embodiment, the stroke capture module 308 receives data at a 16× resolution in both x and y as compared to each pixel. In another embodiment, the stroke capture device 308 receives data at 4× the resolution of the display in each dimension.

The rendering engine 405 converts the binary code into an anti-aliased rasterized image by determining which pixels should contain ink and what grey-level should be applied to each pixel. To do this, the rendering engine 405 renders ink at a higher resolution than the display but without any anti-aliasing. This rendering is stored in an ink buffer. In one embodiment, the ink buffer is 4× the resolution of the display in both x and y, for a total of 16 subsamples per pixel. The rendering engine 405 renders ink using standard algorithms for rendering lines. In one embodiment, the rendering engine 405 renders straight-line segments between sampled points using A.S. Murphy's modification to Bresenham's algorithm for rendering thick lines in rasterized form. In another embodiment, the rendering engine 405 applies a cubic uniform b-spline curve refinement algorithm to fit a curve to the sampled points. The ink buffer represents a binary rasterization of the stroke data, where each unit (subpixel) of the ink buffer is assigned a 1 if ink is present and a 0 if ink is not present. A person of ordinary skill in the art will recognize that other algorithms for producing lines can be used. For example, the algorithms are categorized into three groups: parallel algorithms that divide line generation over multiple processing units, multi-point algorithms that output a fixed number of pixels in each iteration with fewer decision tests per pixel and structural methods that identify periodic patterns in raster lines to reduce or eliminate the number of decision tests.

In a situation where the stroke data is received at a higher resolution than the resolution assigned to the ink buffer, the rendering engine 405 performs a coordinate transformation to downsample the input stroke data to match the resolution of the ink buffer. When the input resolution is a power-of-two multiple of the ink buffer resolution, downsampling can be performed using a bit shift. The electronic paper display 202 receives data at a 16× resolution and performs a two-bit shift for a 4× ink buffer. If, for example, the received bits are 1, 1, 0, 0, the last two bits are discarded and the first two bits are stored. Since the bits are organized according to importance, discarding the last two bits is a negligible loss.

The ink buffer stores rendered strokes in a manner that allows easy correlation between a set of units in the ink buffer and a single pixel. In one embodiment, the ink buffer is represented as a 2D array of two-byte integer elements, where each element represents a single pixel in the screen-resolution frame buffer, and each bit in an element represents a single unit (subpixel) in the higher-resolution ink buffer. FIG. 4B demonstrates one possible mapping between elements 425 in an ink buffer and subpixels where the 16 bits making up each element are arranged in a 4×4 grid starting with the least significant bit in the top left corner and continuing left-to-right and top to bottom, ending with the most significant bit in the bottom right corner. Rendering engine 405 marks a subpixel as containing ink by setting the corresponding bit in the element to 1. The values corresponding to subpixels that do not receive ink are left unchanged, so any ink that was previously rendered to a sub-pixel (e.g. in a previous stroke) will not be erased as new strokes are rendered. Erasure of ink can be accomplished simply by setting the bits corresponding to erased subpixels to 0 rather than 1. One well versed in the art will recognize that many other such mappings are possible. In this example, an ink buffer with four elements 425 is represented.

In another embodiment, the ink buffer is implemented using a sparse matrix representation. One embodiment divides the high-resolution 2D space represented by the ink buffer into chunks and then uses a bitmap to represent whether a particular chunk includes any ink, thus requiring storage only for those chunks containing ink. A different embodiment represents the ink buffer as a binary tree containing only non-zero elements. One well versed in the art will immediately recognize other methods for efficiently implementing sparse matrixes.

Figure 4C:
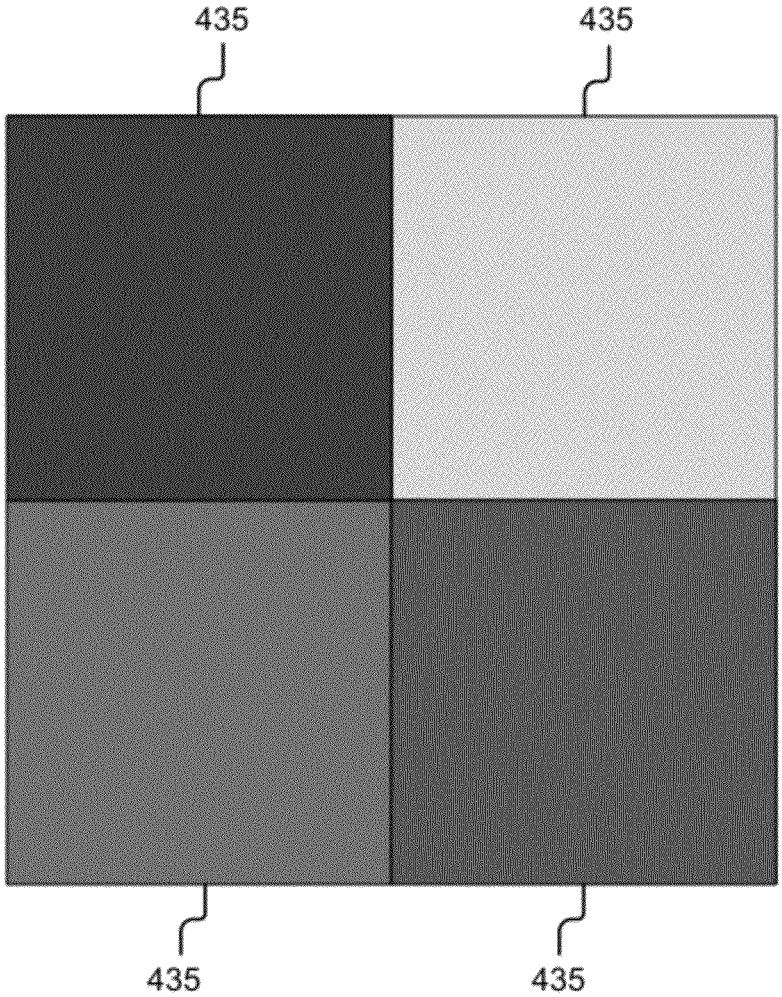
FIG. 4C is a graphical representation of rendered stroke data in accordance with the present embodiment of invention.

Once the ink buffer contains the binary code, the rendering engine 405 determines a color that is appropriate for the pixel based on the number of colors available, the color of the background image and the number of bits that are set to 1 in the element of the ink buffer corresponding to the pixel. In one embodiment, the rendering engine 405 computes the color of a pixel by multiplying the luminance of the pixel's background color by the number of bits set to 1 in the element of the ink buffer corresponding to the pixel, and then dividing the luminance by 16. In one embodiment, the display device 306 is capable of displaying 16 different shades of gray. To determine the appropriate shade of gray, the rendering engine 405 performs compositing by counting the bits that are set to 1 in the element of the ink buffer corresponding to the pixel, multiplying the gray level of background layer at that pixel by this value, and dividing that product by 16 The rendering engine 405 then updates the display to the computed gray level. In one embodiment the rendering engine 405 performs compositing by performing a table lookup of the value stored in the ink buffer element and the background color to determine the proper pixel color. FIG. 4C is an example of a four pixels 435 that result from the rendering engine 405 determining the appropriate shade of gray based on the number of bits that are set to 1 in the element of the ink buffer corresponding to each pixel.

During rendering, the rendering engine 405 rasterizes the stroke data and stores it within an ink buffer that is part of the memory 304. While rendering to the ink buffer, the rendering engine 405 keeps track of which elements in the ink buffer have values that have changed since the display was last updated. Elements whose values have changed are added to a tree data structure, and subsequent additions of elements that have already been added are ignored. The stroke data is organized according to x and y coordinates within the display. Once the rendering engine 405 determines a shade of a pixel because of a line that is rendered in one direction, the shading for that pixel is complete. If the user continues to make a line in the opposite direction that overlaps with the shaded pixels, e.g. while making an "x", the shade of the pixel is recomputed based on both the old and new ink applied. The rendering engine 405 handles each sample received from the stroke capture module 308 in turn, extending the stroke as described above. Once the stroke has been extended to account for the latest sample, the tree structure containing modified elements is traversed and the corresponding pixel colors are transmitted to the presentation module 322 to be rendered to the display.

The rendering engine 405 also tracks the user's actions on the display device 306, and transmits those actions to the presentation module 322 as events for further processing. This is in addition to the rendering of the strokes to the screen, which is initiated before events are generated so that the latency between moving a stylus and drawing the ink is minimized. The rendering engine 405 buffers samples read from the display device 306 and transmits stroke data to the presentation module 395. The timing of this transmission is determines using a variety of techniques including measuring the time since the last set of samples were transmitted and sending a new batch when the time exceeds a pre-set threshold. This is referred to as a timeout. Alternatively, the display device 306 detects a "pen-up" condition by measuring pressure from the stylus or a finger. Once the pressure stops, the rendering engine 405 notifies the presentation module 322 that stroke data is ready for further processing.

Methods

Figure 5:
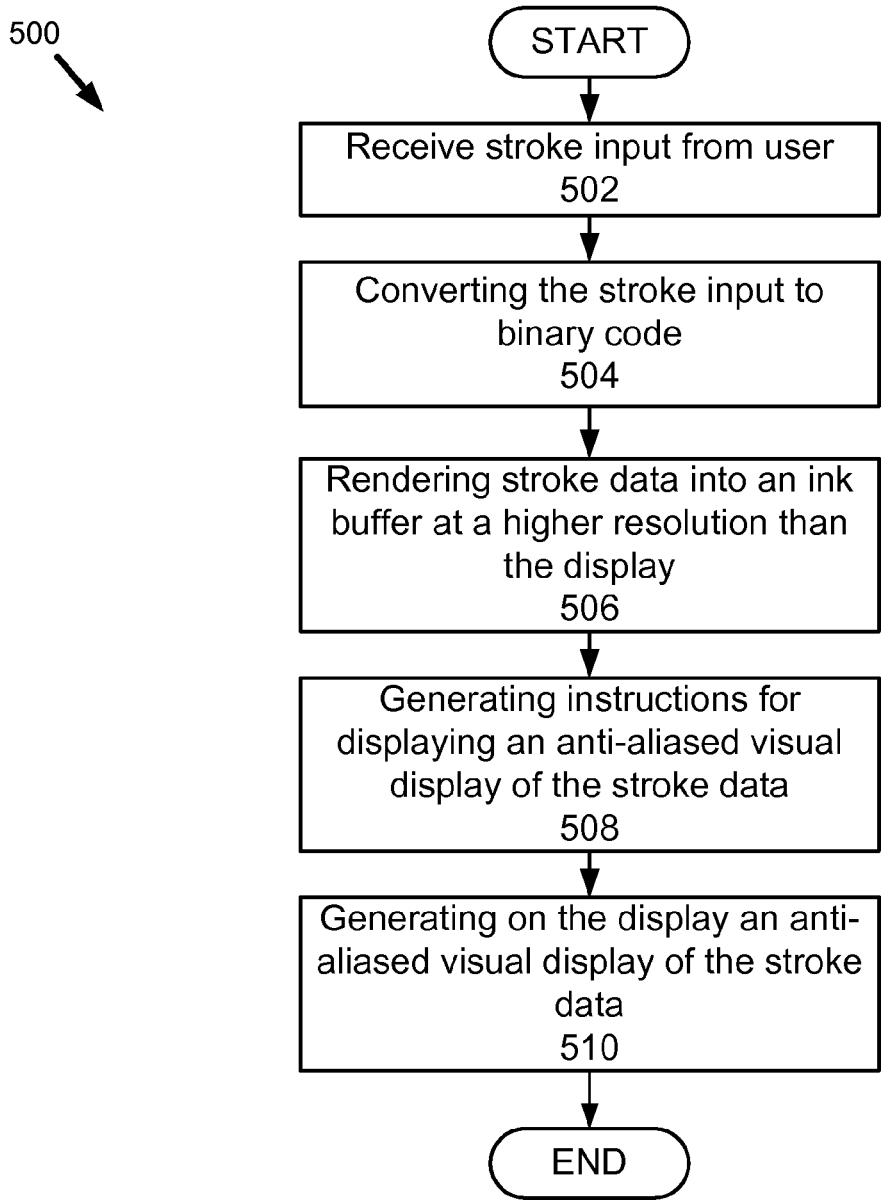
FIG. 5 is a flow diagram illustrating a method for representing stroke data on an electronic paper display in accordance with the present embodiment of invention.

Referring now to FIGS. 5-7, the methods of the present embodiment of invention will be described in more detail.

FIG. 5 illustrates one embodiment of a method for displaying stroke data on an electronic paper display 102. The display device 306 receives 502 stroke input from a user. In one embodiment the stroke input is received via a stylus or a finger. The display device 306 transmits the stroke data to the stroke capture module 308. The stroke capture module 308 includes a digitizer 403 that converts 504 the stroke input to binary code of x and y coordinates. The stroke capture module 308 also includes a rendering engine 405 that renders 506 stroke data into an ink buffer at a higher resolution than the display. The rendering engine 405 generates 508 instructions for displaying an anti-aliased visual display of the stroke data. The input/output module 401 transmits the instructions to the presentation module 322, which works with the display device 306 to display the filled-in pixels. Specifically, the display device 306 generates 510 an anti-aliased visual display of the stroke data.

Figure 6A:
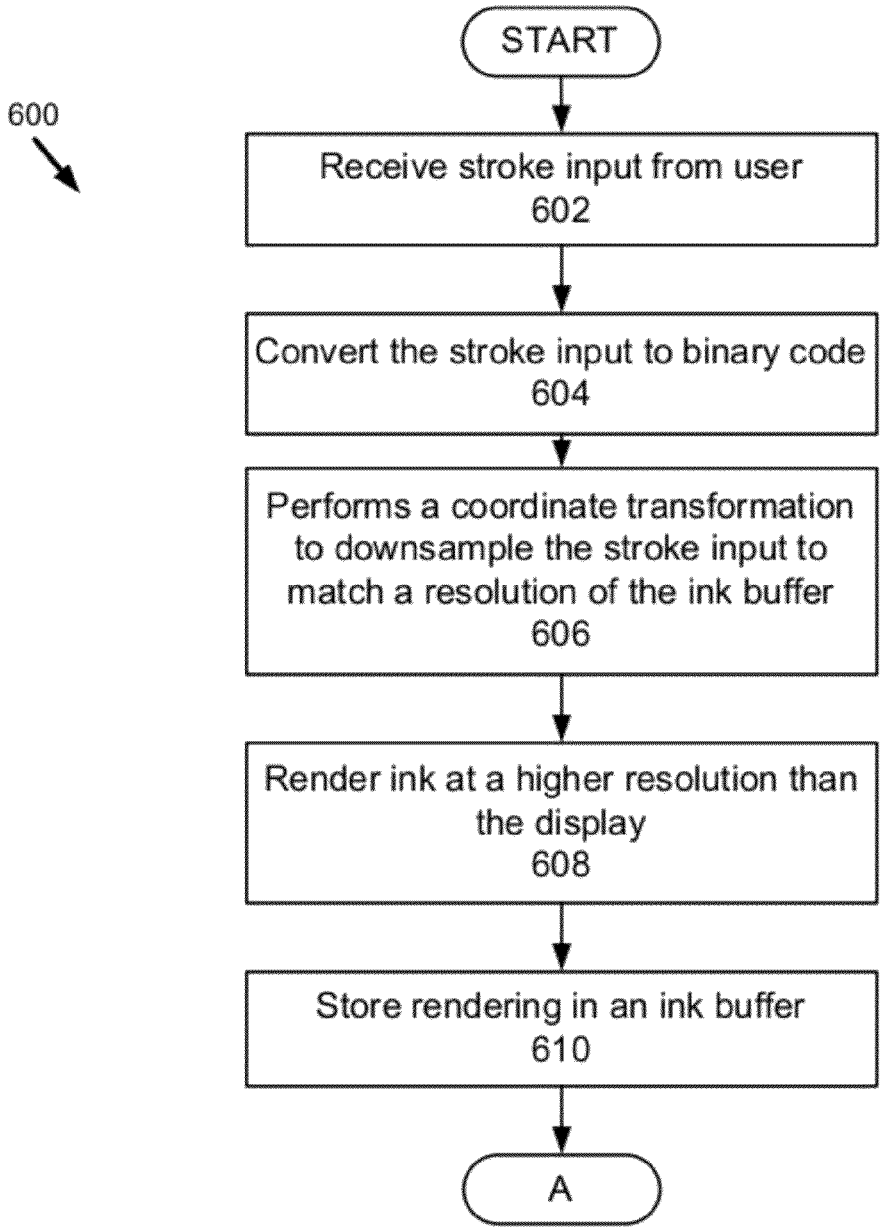
FIG. 6A is a flow diagram illustrating a more detailed method for representing stroke data an electronic paper display in accordance with the present embodiment of invention.
Figure 6B:
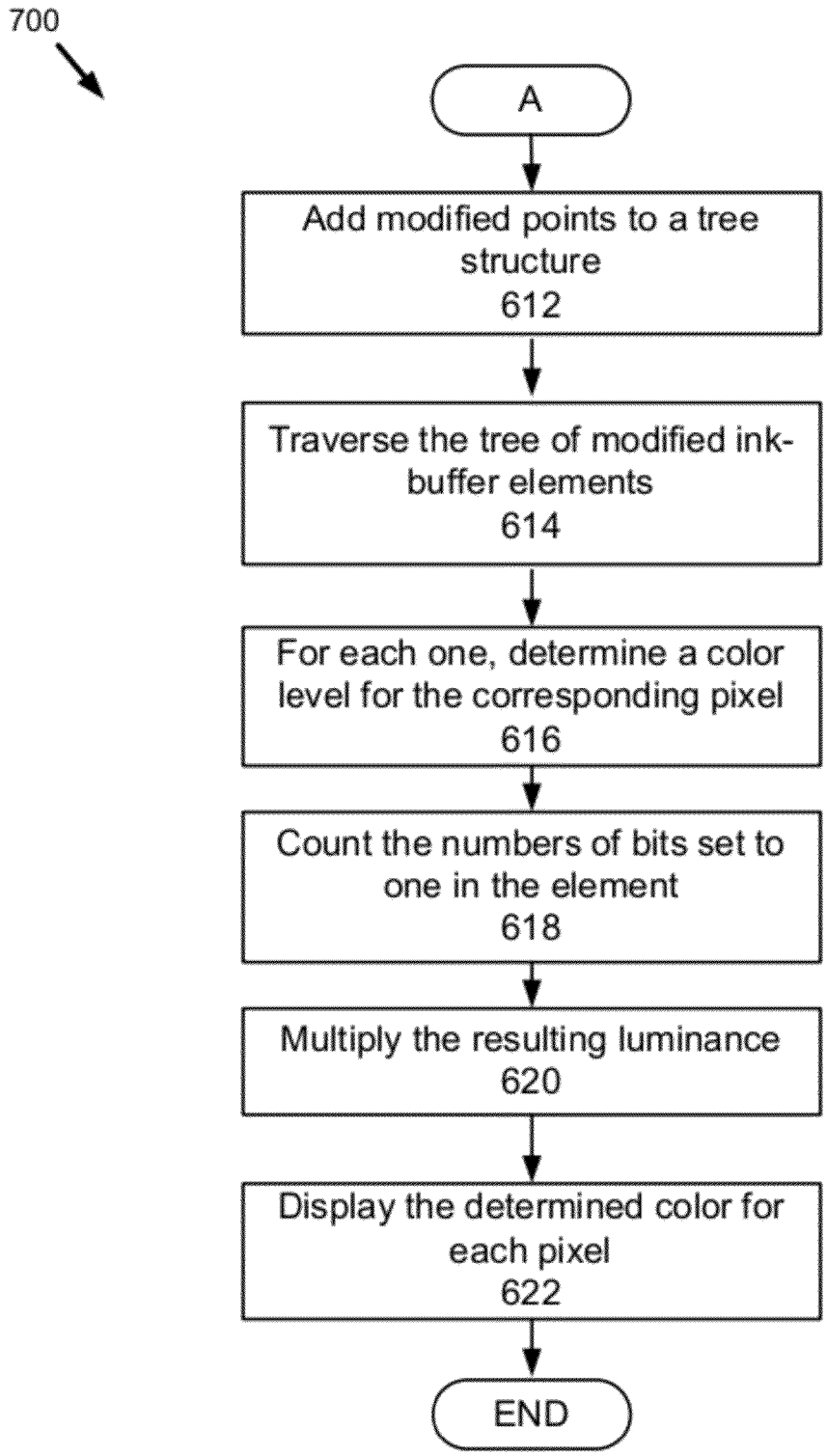
FIG. 6B is a flow diagram illustrating a method for updating an electronic paper display in accordance with the present embodiment of invention.

FIGS. 6A-B illustrate a detailed example of a method for converting stroke data into rendered lines that are displayed on an electronic paper display 202 and updating the stroke data. The display device 306 receives 602 stroke input from a user. The digitizer 403 converts 604 the stroke input to binary code. The rendering engine 405 performs a coordinate transformation to downsample 606 the input stroke data to match the resolution of the ink buffer. Downsampling can be performed using a bit shift. The rendering engine 405 renders 608 the ink at a higher resolution than the display. For example, the rendering engine 405 renders line segments of the desired width using A.S. Murphy's modification to Bresenham's algorithm for rendering thick lines and applies a cubic uniform b-spline curve refinement algorithm to curved segments. Ink drawn to the ink buffer is represented as a bit-map, where a single bit represents each subpixel in the ink buffer element. When rendering to the ink buffer, bits representing subpixels that receive ink are set to one. The rendering engine 405 stores 610 the rendering in an ink buffer that is stored in the memory 304.

The rendering engine 405 also keeps track of which elements in the ink buffer have changed since the last time updates were written to the display device 306 by adding 612 modified points to a tree structure. The rendering engine 405 traverses 614 the tree of modified ink-buffer elements and for each one determines 616 a color level for the corresponding pixel by counting 618 the number of bits set to one in the element, multiplying 620 the resulting lumanince by, for example, 16. The division by 16 can be performed using a bit-shift operator. The instructions for rendering the new color are transmitted to the presentation module 322, which instructs the display device 306 to display 622 the determined color for each pixel.

The foregoing description of the embodiments of the present embodiment of invention has been presented for the purposes of illustration and description. It is not intended to be exhaustive or to limit the present embodiment of invention to the precise document disclosed. Many modifications and variations are possible in light of the above teaching. It is intended that the scope of the present embodiment of invention be limited not by this detailed description, but rather by the claims of this application. As will be understood by those familiar with the art, the present embodiment of invention may be embodied in other specific documents without departing from the spirit or essential characteristics thereof. Likewise, the particular naming and division of the modules, routines, features, attributes, methodologies and other aspects are not mandatory or significant, and the mechanisms that implement the present embodiment of invention or its features may have different names, divisions and/or documents. Furthermore, as will be apparent to one of ordinary skill in the relevant art, the modules, routines, features, attributes, methodologies and other aspects of the present embodiment of invention can be implemented as software, hardware, firmware or any combination of the three. Also, wherever a component, an example of which is a module, of the present embodiment of invention is implemented as software, the component can be implemented as a standalone program, as part of a larger program, as a plurality of separate programs, as a statically or dynamically linked library, as a kernel loadable module, as a device driver, and/or in every and any other way known now or in the future to those of ordinary skill in the art of computer programming. Additionally, the present embodiment of invention is in no way limited to implementation in any specific programming language, or for any specific operating system or environment. Accordingly, the disclosure of the present embodiment of invention is intended to be illustrative, but not limiting, of the scope of the present embodiment of invention, which is set forth in the following claims.

The invention claimed is:

1. A method of displaying strokes on a display, comprising:

receiving stroke data;

rendering the stroke data into an ink buffer at a higher resolution than the display, the ink buffer including elements that correspond to pixels, each element including bits that correspond to a plurality of subpixels of each pixel;

organizing the bits from highest to lowest importance including discarding a portion of the bits based on the organization and a difference between resolutions of the stroke data and the ink buffer;

computing pixel colors by counting a number of the bits in each element that are set to a given value and performing compositing based on a background color of each pixel and the number of the bits, wherein performing compositing comprises multiplying luminance of the background color by the number of the bits; and generating on the display an anti-aliased visual display of the stroke data based on the pixel colors.

2. The method of claim 1, wherein the elements in the ink buffer are represented as a bitmap indicating the subpixels that have received ink.

3. The method of claim 1, wherein the display is an electronic paper display.

4. The method of claim 1, wherein rendering the stroke data into the ink buffer is based at least in part on performing a coordinate transformation to downsample the stroke data to match a resolution of the ink buffer.

5. The method of claim 1, wherein computing the pixel colors further comprises performing a table lookup.

6. The method of claim 1, wherein the elements in the ink buffer that are modified during the rendering are cached and later are used to determine which pixels need updating on the display.

7. The method of claim 1, further comprising tracking which elements in the ink buffer have the pixel colors that changed since a last update.

8. The method of claim 7, further comprising:

adding the elements with a changed pixel color to a tree data structure;

recomputing the pixel colors based on both old and new ink applied;

traversing the tree data structure; and transmitting the pixel colors for display.

9. A system for displaying strokes on a display device comprising:

the display device for receiving stroke data;

a digitizer coupled to the display device to receive the stroke data, the digitizer for converting the stroke data to binary code;

a memory coupled to the digitizer and a rendering engine, the memory including an ink buffer for storing the binary code;

the rendering engine for rendering the stroke data into the ink buffer at a higher resolution than the display device, the ink buffer including elements that correspond to pixels, each element including bits that correspond to a plurality of subpixels of each pixel, for organizing the bits from highest to lowest importance including discarding a portion of the bits based on the organization and a difference between resolutions of the stroke data and the ink buffer and for computing pixel colors by counting a number of the bits in each element that are set to a given value and performing compositing based on a background color of each pixel and the number of the bits, wherein performing compositing comprises multiplying luminance of the background color by the number of the bits; and wherein the display device generates an anti-aliased visual display of the stroke data based on the pixel colors.

10. The system of claim 9, wherein the elements in the ink buffer are represented as a bitmap indicating the subpixels that have received ink.

11. The system of claim 9 wherein the display device is an electronic paper display.

12. The system of claim 9, wherein the rendering engine renders the stroke data into the ink buffer based at least in part on performing a coordinate transformation to downsample the stroke data to match a resolution of the ink buffer.

13. The system of claim 9, wherein the rendering engine computes the pixel colors by performing a table lookup.

14. The system of claim 9, wherein the rendering engine caches the elements in the ink buffer that are modified during the rendering and uses the cached elements to determine which pixels need updating on the display.

15. The system of claim 9, wherein the rendering engine tracks which elements in the ink buffer have the pixel colors that changed since a last update.

16. The system of claim 15, wherein the rendering engine adds the elements with a changed pixel color to a tree data structure, recomputes the pixel colors based on both old and new ink applied, traverses the tree data structure and transmits the pixel colors for display.

17. The system of claim 9, wherein the rendering engine does not save additional binary code to the memory if it describes a pixel that already corresponds to the binary code in the memory.

18. A non-transitory computer readable storage medium comprising a computer program, wherein the computer program when executed on a computer causes the computer to:

receive stroke data;

render the stroke data into an ink buffer at a higher resolution than a display, the ink buffer including elements that correspond to pixels, each element including bits that correspond to a plurality of subpixels of each pixel;

organize the bits from highest to lowest importance including discarding a portion of the bits based on the organization and a difference between resolutions of the stroke data and the ink buffer;

compute pixel colors by counting a number of the bits in each element that are set to a given value and performing compositing based on a background color of each pixel and the number of the bits, wherein performing compositing comprises multiplying luminance of the background color by the number of the bits; and generate on the display an anti-aliased visual display of the stroke data based on the pixel colors.

19. The computer readable storage medium of claim 18, wherein the elements in the ink buffer are represented as a bitmap indicating the subpixels that have received ink.

20. The computer readable storage medium of claim 18, wherein the display is an electronic paper display.

* * * * *